US005727987A

United States Patent [19]

Gottschlad

[11] Patent Number: 5,727,987

[45] Date of Patent: Mar. 17, 1998

[54] APPARATUS FOR THE GRINDING OF AT LEAST THE PERIPHERAL EDGE OF EYEGLASS LENSES AND METHOD

[75] Inventor: Lutz Gottschlad, Meerbusch, Germany

[73] Assignee: Wernicke & Co. GmbH, Germany

[21] Appl. No.: 686,340

[22] Filed: Jul. 25, 1996

[30] Foreign Application Priority Data

Jul. 26, 1995 [DE] Germany ..... 195 27 222.6

[51] Int. Cl.[6] ..... B24B 1/00; B24B 49/00

[52] U.S. Cl. ..... 451/5; 451/6; 451/8; 451/43; 451/44; 451/255

[58] Field of Search ..... 340/680; 451/5, 451/6, 8, 42, 43, 44, 255, 256

[56] References Cited

U.S. PATENT DOCUMENTS

| | | | |
|---|---|---|---|
| 3,528,326 | 9/1970 | Kilmer et al. | 451/6 X |
| 4,096,684 | 6/1978 | Akaba et al. | 451/6 X |
| 4,638,601 | 1/1987 | Steere et al. | 451/6 X |
| 4,723,376 | 2/1988 | Blum et al. | 451/6 |
| 5,155,940 | 10/1992 | Suzuki | 451/6 X |
| 5,454,194 | 10/1995 | Gottschald | 451/5 X |
| 5,588,899 | 12/1996 | Gottschald | 451/6 X |

FOREIGN PATENT DOCUMENTS

| | | | |
|---|---|---|---|
| 379427 | 7/1990 | European Pat. Off. | 451/6 |
| 174231A | 10/1951 | Germany . | |
| 895115 | 10/1953 | Germany | 451/6 |
| 4127094 | 2/1993 | Germany . | |
| 2-160463 | 6/1990 | Japan | 451/43 |
| 3-154760 | 7/1991 | Japan | 451/6 |
| 494242 | 12/1975 | U.S.S.R. | 451/6 |
| 595059 | 11/1947 | United Kingdom . | |
| 24273 | 12/1993 | WIPO | 451/43 |

OTHER PUBLICATIONS

"Lens Centering Device", Patents Abstract of Japan, M–479, vol. 10, No. 134, May 17, 1986.

*Primary Examiner*—Timothy V. Eley

*Attorney, Agent, or Firm*—Ostrolenk, Faber, Gerb & Soffen, LLP

[57] ABSTRACT

An apparatus for the grinding of at least the peripheral edge of eyeglass lenses, having at least one grinding wheel, at least one rotatable shaft having a holding head for a lens blank, and a recognition device for the optical values and, possibly, the axis position of a cylindrical or prismatic ground surface of the lens blank held by the holding head, and/or for coordinate markings on the lens blank held by the holding head.

20 Claims, 2 Drawing Sheets

APPARATUS FOR THE GRINDING OF AT LEAST THE PERIPHERAL EDGE OF EYEGLASS LENSES AND METHOD

BACKGROUND OF THE INVENTION

The present invention relates to an apparatus and a method for the grinding of at least the peripheral edge of eyeglass lenses, having at least one grinding wheel and at least one rotatable shaft and a holding head for a lens blank, having at least one control means for the CNC-controlled grinding of the lens blank in accordance with a predetermined contour of the lens, at least one input device connected to the control means for the predetermined contour of the lens, the optical values, and/or possibly the axis position of a cylindrical or prismatic ground surface, and/or the decentration values of the predetermined contour with respect to the optical axis of the lens blank.

Such an apparatus, which comprises at least one means for the CNC-controlled grinding of the blank in accordance with predetermined optical values and/or a predetermined contour of the lens is described in German Unexamined Application for Patent OS 41 27 094 of the same applicant.

In that apparatus at least one input device connected to the control means for the in-putting of the optical values of the lens and/or for the decentration values of the predetermined contour and/or the axis position and/or the position of the near or reading portion with respect to the optical axis, as well as at least one manipulator connected to the control means for the receiving and positioning of the lens blank in accordance with the values entered into the input device and for the corresponding insertion of the lens blank in precise position in the holder.

The manipulator grips a lens blank at its edge and conducts it into the opened holder of the lens grinding machine. In this connection the manipulator is so controlled that the lens blank is positioned with respect to the axis of rotation of the holder in accordance with the entered decentration values. When the holder then clamps the lens blank and the manipulator releases the lens blank, the grinding process can be carried out in accordance with predetermined optical values and/or in accordance with a predetermined contour of the lens with due consideration of the decentration values. Blocking of the lens blank before its insertion in the holder in the lens edge grinding machine can be dispensed with here if the holder is developed in such a manner that it clamps, fixed in rotation, the lens blank which has been precisely positioned by the manipulator. In addition, or instead of, the decentration values, the position of the predetermined contour relative to the axis of rotation of the holder can also be taken into consideration by the input device in the case of lenses with cylindrical or prismatic ground surface and/or the optical values of the lens to be ground, namely in the case of multifocal lenses the position of near or reading parts.

In order to be able to align the lens blank automatically, there may be present in the known device a vertex refractometer, which has a sensor and a data connection to the control means, for the positioning of the lens blank, held by the manipulator, in the optical center, and recording of the data of the optical center for the following insertion of the lens blank in precise position into the holder.

Furthermore, a possibility is described for controlling the manipulator by a machine-readable marking of the optical values on the lens blank. The lens blank which is gripped by the manipulator can then be guided within the region of a sensor where the optical values are read. By means of a data connection to the control means, the insertion of the lens blank in its precise position in the holder can be controlled as a function of the optical values detected by the sensor and of the decentration values and/or the axis position of a predetermined contour relative to the axis of rotation of the holder which have been entered.

Finally, it should also be mentioned that a large number of different lens blanks can be arranged in a storage container which is accessible to the manipulator and which has a machine-readable marking for each of the lens blanks arranged as an address on the storage container. The marking is read by a sensor on the manipulator and, via a data connection to the control means, controls the removal of a lens blank from the storage container corresponding to the optical values entered.

SUMMARY OF THE INVENTION

It is an object of the present invention to provide a simplified apparatus and a method for the grinding of at least the peripheral edge of eyeglass lenses which do not require the placing of a block or suction head on the lens blank by means of a blocking device and, in connection with which, no great demands are made on the insertion of a lens blank into the lens-grinding machine.

Proceeding from this object it is proposed, in an apparatus of the aforementioned type, that the shaft be developed as a hollow shaft and the holding head be developed in ring shape and a recognition device from a coaxial optical observation system for the optical values and/or possibly the axis position of a cylindrical or prismatic ground surface of the lens blank held by the holding head and/or for ordinary markings on the lens blank held by the holding head has a converter for converting the optical values received, possibly the axis position and/or the customary markings, into electric signals, the control means for the CNC-controlled grinding of the lens blank is connected with the converter and, acted on by the signals from the converter, controls the grinding with due consideration of the values noted by the recognition device.

To be sure, apparatus for the grinding of the peripheral edge of lenses are known in which a rotatable hollow shaft having a ring shaped holding head for a lens and a recognition device from a coaxial optical observation system is present which makes it possible automatically to obtain the alignment of the lens on the holding head with respect to its optical and thus also its geometrical axis. Such an apparatus is described in British Patent 595 059 and in Japanese Patent Application 60-259 365.

In those known apparatus, after a lens has been placed on the holding head, the position of the optical axis of the lens with respect to the axis of the hollow shaft is checked, whereupon, via the optical observation system, a device for the aligning of the lens is controlled so that the optical axis of the lens coincides with the axis of the hollow shaft. The machining of the edge of the lens is then effected.

As compared with this, the apparatus in accordance with the invention does not require any alignment of the lens blank, at least when it is placed with its optical axis within permissible deviations on the holding head of the hollow shaft, since these deviations are detected by the optical observation system and fed, via the converter, to the CNC-control for the peripheral grinding of the lens blank and converted there into corresponding correction values upon the grinding. In addition, the optical values and/or possibly the axis position of a cylindrical or prismatic ground surface of the lens blank held on the holding head and/or for ordinary markings on the lens blank held by the holding head are taken into consideration in the CNC control for the grinding of the lens blank without the lens blank having to be aligned in any manner with respect to these values.

The recognition device may consist of a vertex refractometer by which the optical values and possibly the axis position of a cylindrical or prismatic ground surface of the lens blank held by the holding head can be recorded. The recognition device may also consist of an optical or opto-electronic observation unit by which ordinary markings on the lens blank by dots, crosses or the like can be recognized.

This optical observation system, preferably a vertex refractometer, can have an eyepiece or a ground-glass screen for viewing the image of the lens blank. In this case, the figure of the coordinate axes and a graduated scale can be visible in order to be able to observe the position of the lens blank.

The recognition device can also consists of an opto-electronic observation system having an electronic recording camera and a picture screen display of at least regions of the lens blank, in which connection the recording camera can preferably consist of a CCD-camera which has an electronic image processing and evaluation system in order to produce the picture-screen display of the lens blank.

The hollow shaft with the holding head for the lens blank can hold the lens blank on one side by vacuum so that the other side of the lens blank is free for the arranging of the recognition device.

It is also possible to convert an ordinary lens-holding device consisting of coaxial half shafts so that the half shafts which clamp the lens blank by means of annular holding heads are hollow, so that the recognition device can be arranged at least in part in these hollow half shafts.

With this arrangement, the eyepiece or the ground-glass screen or the picture screen can be arranged fixed on a housing of the apparatus, the image of the lens blank which is held by the annular holding head being conducted optically or electronically from the part of the recognition device arranged in the hollow half shafts to the eyepiece or the ground-glass screen or the picture screen.

For the placing of the lens blank on the holding head, a manipulator can advantageously be employed for the receiving and placing on thereof, which manipulator can be connected to the control means of the system. This manipulator can be controlled in accordance with pre-decentration in such a manner that it brings the lens blank with its optical axis or geometrical axis to the axis of the holding head on the shaft. In this case, the values noted by the recognition device and converted by the converter into electric signals are used in order to take the optical values or the axis position and/or the customary markings into account by computer in the CNC-controlled grinding of the peripheral edge.

In order to achieve the object indicated at the start, there is furthermore proposed a method for the CNC-controlled grinding by a control means of a lens blank in accordance with a predetermined contour of the lens in an apparatus for the grinding of at least the peripheral edge of the lens blank which is held by a holding head on a rotatable shaft and is to be machined by at least one grinding wheel, which method, in accordance with the invention, comprises the following steps:

Inputting of the contour, the optical values, possibly the axis position of a cylindrical or prismatic ground surface and/or the decentration values of the predetermined contour with reference to the optical axis of the lens blank into the control means, placing the lens blank on the holding head, recording the position of the lens blank on the holding head with respect to the optical axis with reference to the axis of the rotatable shaft and/or the axis position of a cylindrical or prismatic ground surface or with respect to ordinary markings on the lens blank by means of a recognition device, converting the recorded values into electric signals by means of a converter, inputting the signals into the control means, and taking these signals into account in the CNC-controlled grinding of the predetermined contour of the lens blank, possibly in the axis position of a cylindrical or prismatic ground surface and/or in the decentration values of the predetermined contour, as well as grinding of the contour with due consideration of these values.

Other features and advantages of the present invention will become apparent from the following description of the invention which refers to the accompanying drawings.

BRIEF DESCRIPTION OF THE DRAWING(S)

FIG. 1 is a perspective view of a lens-edge grinding machine in accordance with the invention FIG. 2 is a diagrammatic top view, partially in section, of a lens-edge grinding machine in accordance with a second embodiment, and FIG. 3 is a diagrammatic showing of a lens blank having a four-point marking.

DETAILED DESCRIPTION OF THE INVENTION

Figure 1:
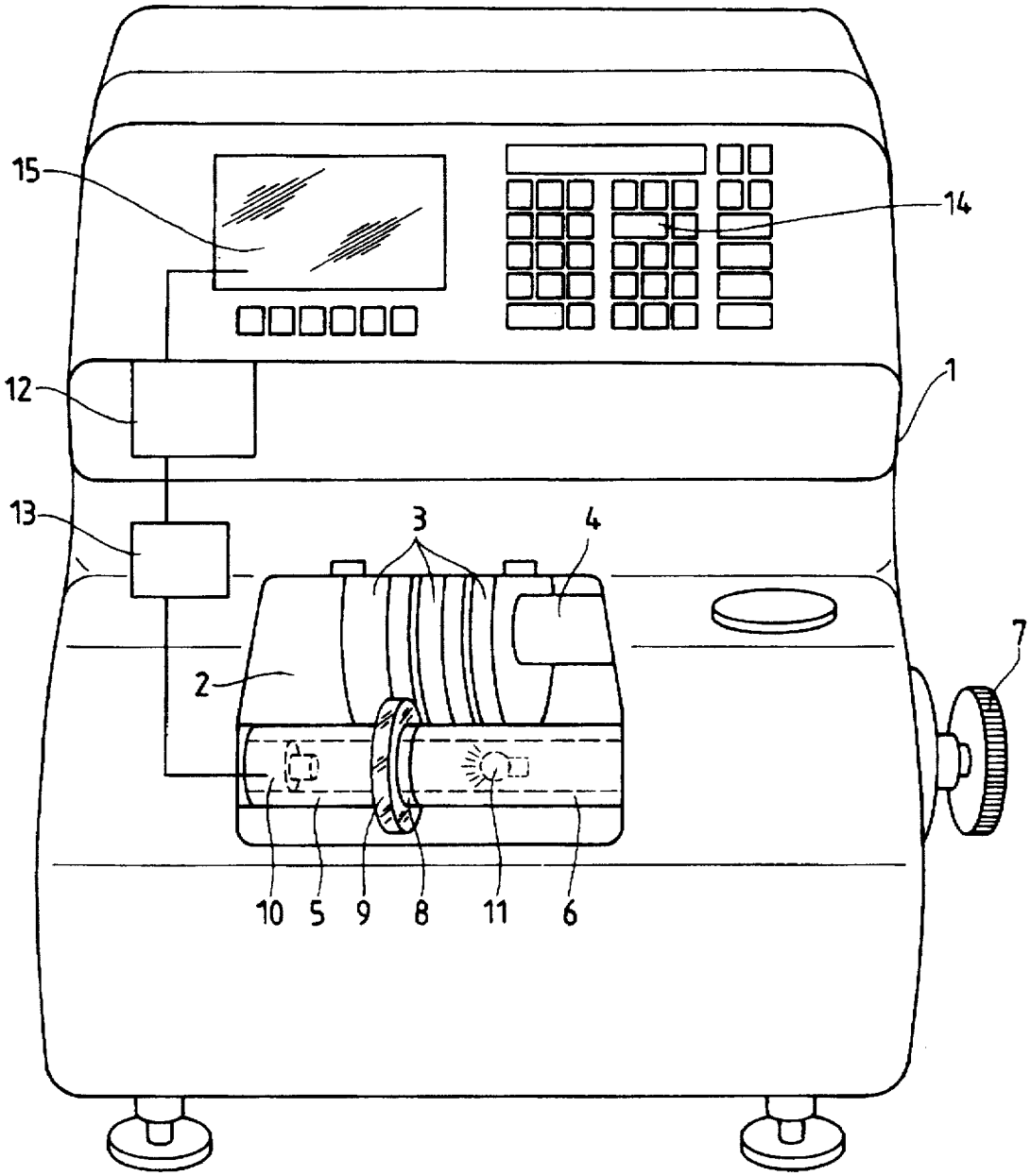

A housing 1 of a known CNC-controlled eyeglass lens edge grinding machine is shown, within the grinding chamber 2 of which there are three grinding wheels 3 on a shaft 4. One of the grinding wheels 3, which has a cylindrical surface, serves for the rough grinding of the contour of an eyeglass lens, while the other two grinding wheels 3 serve for the grinding of different bevels on the rough-ground lens.

In accordance with the present invention, parallel to the shaft 4 which bears the grinding wheels 3 there are coaxial rotatable hollow half shafts 5, 6, the half shaft 6 being axially displaceable. The half shafts 5, 6 are provided at their ends with annular holding heads 8 (only the head 8 for the half shaft 6 being shown), between which a lens blank 9 can be clamped. The clamping can be effected automatically or by means of a knob 7.

The grinding of the peripheral edge in accordance with a predetermined shape of the lens is effected in known manner under CNC-control by a control means 12. The control means 12 is connected to an input device in the form of a keyboard 14 by means of which the predetermined shape of the contour, the decentration values, and, if given, the axis position of the cylindrical or prismatic ground surface can be entered.

Figure 3:
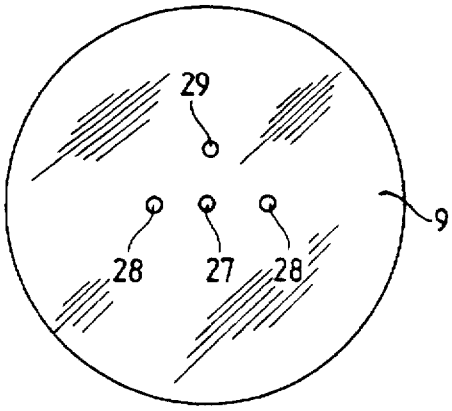

Within the hollow half shaft 6 there is an illuminating means 11, while a recognition device in the form of a CCD-camera 10 is arranged, coaxial thereto, in the hollow half shaft 5. This CCD-camera is able to record ordinary markings, for instance a four point marking 27, 28, 29, shown in FIG. 3, and convert them into electric signals. The point 27 of the four-point marking designates the optical center of the lens blank 9, while the axis position of a cylindrical or prismatic ground surface results from the points 28, 29.

The signals produced by the CCD-camera 10 pass into a converter 13 and are converted there into signals which can be used by the control means 12 so that the picture of the lens blank 9 with the markings taken by the CCD-camera 10 can be shown on a screen 15.

This screen 15 displays coordinate axes with a graduated scale with the origin of the coordinate axes being the axis of the hollow half shafts 5, 6.

An exact positioning of the lens blank 9 is not necessary since the values recorded by the CCD-camera 10 are entered by the converter 13 into the control means 12 and are taken into consideration by computer in the CNC-controlled grinding of the lens. This method can be carried out particularly advantageously upon the insertion of the lens blank by hand, in the manner that the insertion is effected in an approximate manner by observation of the picture screen 15, and any deviations which are still present are then taken into account by computer.

Figure 2:
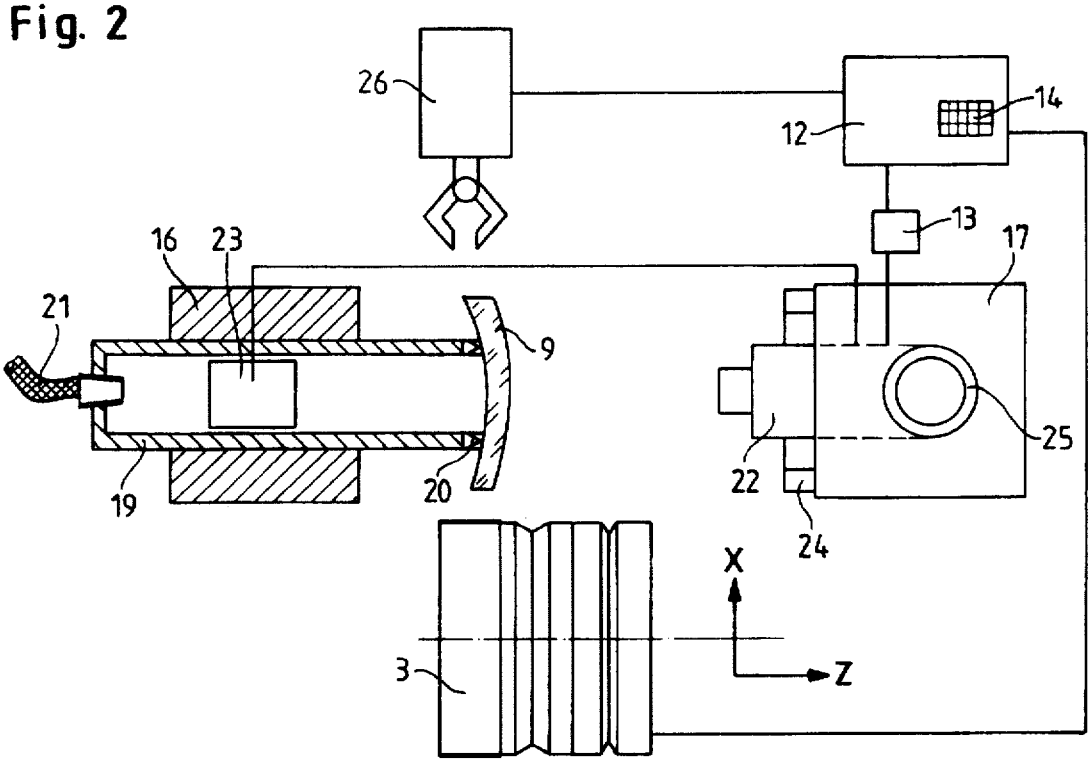

In the embodiment shown in FIG. 2, there is only one hollow shaft 19 having an annular holding head 20, on which the lens blank 9 is held fast by vacuum. For this purpose, a vacuum connection 21 is provided on the hollow shaft. The hollow shaft 19 is rotatably mounted on a bearing bracket 16 which is fixed to the housing, while the grinding wheels 3 are displaceable, in a manner not shown in the drawing by a control means under CNC-control in X-direction and Z-direction by a control means 12. On a support 17 which is fixed to the housing there is arranged, coaxial to the hollow shaft 19, a vertex refractometer 22 which cooperates with an auxiliary system 23 arranged in the hollow shaft 19. A test mark connected with the auxiliary system 23 is visible on a diopter-graduated scale in the eyepiece 25. This vertex refractometer 22 can be connected in the manner already described by a converter 13 to the control means 12 and permits both observation of the lens blank in the eyepiece 25 as well as the taking into account by computer of the recorded values for the CNC-controlled grinding of the lens blank 9.

In this embodiment a manipulator 26 is provided which, in a manner not shown in detail, receives a lens blank 9 and places it on the annular holding head 20.

This manipulator 26 can be developed in relatively simple manner when it serves merely to place a lens blank 9 with its geometric axis coaxial to the axis of the half shaft 19 on the annular holding head 20. Any inaccuracies upon the placing-on of the lens blank 9 as well as the axis position determined by the vertex refractometer 22 of a cylindrical or prismatic ground surface then pass, via the converter, to the control means 12 and are taken into account by computer in the form grinding of the lens.

The entire process can be observed through the eyepiece 25 or on a picture screen or on a ground-glass screen.

Of course, a CCD-camera can also be used in the embodiment of FIG. 2 instead of a vertex refractometer 22. In such case, it is advantageous to arrange an annular illuminating device 24 on the support 17 or to develop the auxiliary system 23 as an illuminating device.

Furthermore, it is also possible to provide, instead of the vertex refractometer 22, a simple observation lens which bears the figure of the coordinate axes with scale as well as an angle graduation, so that a lens blank 9 having a four-point marking can be easily aligned approximately by hand, while any inaccuracies in the alignment are fed from the observation optics via the converter to the CNC control and taken into consideration by the computer.

The essential difference between the apparatus of the invention and the traditional apparatus for the grinding of the peripheral edge of eyeglass lens is that the lens blank 9 is placed on a holding head 8 or 20 without being previously provided with a block or suction head and is checked, by a recognition device in the form of a simple observation optics, a vertex refractometer or a CCD-camera, with respect to the optical values and possibly the axis position of a cylindrical or prismatic ground surface and/or customary markings on the lens blank held by the holding head, and the signals obtained by means of the vertex refractometer or the CCD-camera are used for the computerized correction of the CNC-controlled grinding of the peripheral edge.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A method for grinding at least the peripheral edge of a lens blank with grinding apparatus having a shaft with an axis of rotation and a holding head for holding the lens blank and a grinding wheel for grinding the peripheral edge, the method comprising the steps of:

(a) inputting into the apparatus predetermined optical parameters;

(b) placing the lens blank on the holding head so that the lens blank is held on the holding head;

(c) recording one or more observable optical characteristics of the lens blank as held on the holding head, including the position of an optical axis of the lens blank relative to the axis of the shaft; and (d) grinding the lens blank in accordance with the parameters inputted in step (a) and the characteristics recorded in step (c).

2. A method according to claim 1, wherein the predetermined optical parameters include one or more of a contour of the lens blank, the optical values thereof, the position of a surface thereof relative to the axis of the shaft and the decentration values of contour with reference to the optical axis of the lens blank.

3. A method according to claim 1, wherein the optical characteristics further include one or more of the position of a surface of the lens blank relative to the axis of the shaft and markings on the lens blank.

4. Apparatus for the grinding of at least the peripheral edge of eyeglass lenses, which comprises:

a hollow rotatable shaft having an axis of rotation and a holding head for holding a lens blank to be ground, the lens blank having an optical axis;

optical observation means including optical recognition means positioned within the hollow shaft for optically determining one or more optical characteristics of the lens blank, including the position of the optical axis of the lens blank relative to the axis of the shaft;

at least one grinding wheel; and control means for controlling the grinding wheel in accordance with predetermined criteria representation of a desired lens contour and with the one or more optical characteristics determined by the optical recognition means.

5. Apparatus for the grinding of at least the peripheral edge of eyeglass lenses, which comprises:

a first rotatable hollow shaft having an axis of rotation and a first holding head for holding a lens blank to be ground, the lens blank having an optical axis;

an optical observation system including a recognition device positioned within the hollow shaft coaxial with the axis of the shaft for optically determining one or more optical characteristics of the lens blank, including the position of the optical axis of the lens blank relative to the axis of the shaft;

at least one grinding wheel; and a control unit for controlling the grinding wheel in accordance with predetermined criteria representation of a desired lens contour and with the one or more optical characteristics determined by the optical recognition means.

6. Apparatus in accordance with claim 5, wherein the optical observation system includes a converter for converting the one or more optically determined characteristics into electrical signals.

7. Apparatus according to claim 6, wherein the lens has optical values and the one or more optical characteristics further include one or more of the optical values of the lens blank, and the position of a surface of the lens blank relative to the axis of the shaft.

8. Apparatus in accordance with claim 5, wherein the first holding head is ring shaped.

9. Apparatus in accordance with claim 5, wherein the recognition device is positioned within the first hollow shaft.

10. Apparatus according to claim 5, further including a second hollow, rotatable shaft coaxial with the first shaft, the second shaft having a second, holding head, the lens blank being clampable between the first and the second holding heads.

11. Apparatus according to claim 10, wherein the recognition device is arranged at least in part in one of the first and second shafts.

12. Apparatus according to any one of claims 2–11, wherein the optical observation system includes a vertex refractometer.

13. Apparatus according to any one of claims 5–11, wherein the recognition device includes an opto-electronic observation arrangement having an electronic recording camera.

14. Apparatus according to claim 13, wherein the camera is a CCD-camera.

15. Apparatus according to claim 14, wherein the optical observation system includes an eyepiece and means for conducting a picture of the lens blank optically to the eyepiece.

16. Apparatus according to claim 14, wherein the optical observation system includes a ground-glass screen and means for electronically conducting a picture of the lens blank to the ground-glass screen.

17. Apparatus according to claim 14, wherein the optical observation system includes a picture screen display and means for optically conducting a picture of the lens blank to the picture screen display.

18. Apparatus according to any one of claim 14, wherein the optical observation system includes an eyepiece and means for electronically conducting a picture of the lens blank to the eyepiece.

19. Apparatus according to claim 18, wherein the optical observation system includes a ground-glass screen and means for electronically conducting a picture of the lens blank to the ground-glass screen.

20. Apparatus according to claim 18, wherein the optical observation system includes a picture screen display and means for electronically conducting a picture of the lens blank to the picture screen display.

* * * * *